US008925572B2

(12) United States Patent
Shih

(10) Patent No.: US 8,925,572 B2
(45) Date of Patent: Jan. 6, 2015

(54) CONNECTING STRUCTURE OF A FAUCET BODY AND A CONTROL VALVE

(71) Applicant: Sen-Tien Shih, Changhua (TW)

(72) Inventor: Sen-Tien Shih, Changhua (TW)

(73) Assignee: Tai-World Mfg. Co., Ltd., Changhua (TW)

( * ) Notice: Subject to any disclaimer, the term of this patent is extended or adjusted under 35 U.S.C. 154(b) by 57 days.

(21) Appl. No.: 13/762,525

(22) Filed: Feb. 8, 2013

(65) Prior Publication Data

US 2014/0224362 A1 Aug. 14, 2014

(51) Int. Cl.

| | |
|---|---|
| ***F16K 5/00*** | (2006.01) |
| ***E03C 1/04*** | (2006.01) |
| ***F16K 27/12*** | (2006.01) |

(52) U.S. Cl.

CPC ..... *F16K 27/12* (2013.01)
USPC ..... 137/315.12; 137/801; 4/677

(58) Field of Classification Search

CPC ..... F16K 27/05; F16K 43/00; F16K 31/602; E03C 1/04; E03C 1/0401; E03C 1/0402
USPC ..... 137/315.09, 343, 35, 625.4, 315.12, 137/801; 4/675–678

See application file for complete search history.

(56) References Cited

U.S. PATENT DOCUMENTS

| | | | | |
|---|---|---|---|---|
| 3,750,708 | A * | 8/1973 | Staat et al. | 137/625.17 |
| 5,368,071 | A * | 11/1994 | Hsieh | 137/625.41 |
| 5,634,220 | A * | 6/1997 | Chiu | 4/678 |
| 6,073,972 | A * | 6/2000 | Rivera | 285/64 |
| 6,219,860 | B1 * | 4/2001 | Chang | 4/678 |
| 6,390,128 | B1 * | 5/2002 | Tung | 137/625.17 |
| 6,912,742 | B1 * | 7/2005 | Wang | 4/695 |
| 7,198,064 | B1 * | 4/2007 | Hsiao | 137/625.4 |
| 7,997,513 | B2 * | 8/2011 | Chen et al. | 239/243 |
| 8,033,290 | B2 * | 10/2011 | Hsiao | 137/315.12 |
| 2009/0277520 | A1 * | 11/2009 | Wang | 137/801 |

* cited by examiner

*Primary Examiner* — John K Fristoe, Jr.
*Assistant Examiner* — Kevin Barss
(74) *Attorney, Agent, or Firm* — Alan D. Kamrath; Kamrath IP Lawfirm, P.A.

(57) ABSTRACT

A connecting structure of a faucet body and a control valve contains a faucet body, a fixing cylinder, a guiding seat, a control valve, and an outlet pipe. The faucet body includes a first segment, a second segment, a positioning rim, and a receiving space. The fixing cylinder is fitted into the faucet body and includes a circular cavity, an orifice, and two apertures. The guiding seat is disposed in the circular cavity and includes two grooves and two inlets. The control valve is inserted into the receiving space from the first segment of the faucet body, and a bottom end of the control valve is biased against the guiding seat. The outlet pipe couples with the faucet body and communicates with the guiding seat. Thereby, the guiding seat and the control valve are fixed in the faucet body, and a shape of the faucet body is geometrical and variable.

6 Claims, 12 Drawing Sheets

FIF. 3

A-A

CONNECTING STRUCTURE OF A FAUCET BODY AND A CONTROL VALVE

BACKGROUND OF THE INVENTION

1. Field of the Invention

The present invention relates to a faucet and, more particularly, to a connecting structure of a faucet body and a control valve that has a variable aesthetics appearance and is manufactured at a low cost.

2. Description of the Prior Art

A conventional faucet is integrally formed from bronze material, but its internal waterway is so curved to cause poor quality, complicated manufacture, high production cost, defective products, heavy weight, and environmental pollution in a bronze casting process. To improve such defects, a faucet body and an outlet pipe are separately made, so that they are connected together after a copper bar is drilled and turned. However, such an improvement has an expensive manufacture cost and a troublesome working process. In addition, a shape of the faucet body is limited, such as a circular or a square shape.

Besides, some faucet bodies and output pipes are made of brass material. However, these faucet bodies are circular without changing their shapes, and their thicknesses are so thin that the faucet bodies are coupled with the output pipes by using inner tubes and outer tubes, thus having a high assembly cost. Furthermore, if the inner tubes cannot match with the outer tubes well, the inner tubes cannot be inserted into the outer tubes, or the inner tubes cannot contact with internal walls of the outer tubes, thus having an insecure assembly.

The present invention has arisen to mitigate and/or obviate the afore-described disadvantages.

SUMMARY OF THE INVENTION

The primary object of the present invention is to provide a connecting structure of a faucet body and a control valve in which a faucet body is stamped and welded from a metal piece and is formed in a hollow tube shape to match with a fixing cylinder including a circular cavity. Thus, a guiding seat and a control valve are fixed in the faucet body, and a shape of the faucet body is geometrical and variable, thus increasing an aesthetics appearance.

Another object of the present invention is to provide a connecting structure of a faucet body and a control valve in which the faucet body is stamped and welded from the metal piece and is formed in a hollow tube shape to match with the fixing cylinder including the circular cavity. Thus, the guiding seat and the control valve are fixed in the faucet body, so an interior of the faucet body cannot be worked precisely, thus accelerating the working process and lowering material and production costs.

A connecting structure of a faucet body and a control valve in accordance with the present invention contains:

a faucet body stamped and welded from a metal piece and formed in a hollow tube shape, with the faucet body including a first segment, a second segment relative to the first segment, a positioning rim defined on an inner wall thereof between the first segment and the second segment, and a receiving space formed between the positioning rim and the first segment;

a fixing cylinder formed in a shape corresponding to a shape of an interior of the faucet body, with the fixing cylinder fitted into the receiving space from the first segment of the faucet body and retaining with the positioning rim and including a circular cavity, an orifice defined on an outer wall thereof and communicating with the circular cavity, and two apertures arranged on a bottom end thereof to insert two inlet pipes;

a guiding seat disposed in the circular cavity of the fixing cylinder and including two grooves defined on a top surface thereof, and two inlets passing downwardly therealong and having two lower ends which connect with the two inlet pipes of the fixing cylinder;

a control valve inserted into the receiving space from the first segment of the faucet body, with a bottom end of the control valve biased against the guiding seat; and an outlet pipe coupling with the faucet body and communicating with the outlet of the guiding seat.

DETAILED DESCRIPTION OF THE PREFERRED EMBODIMENTS

Figure 1:
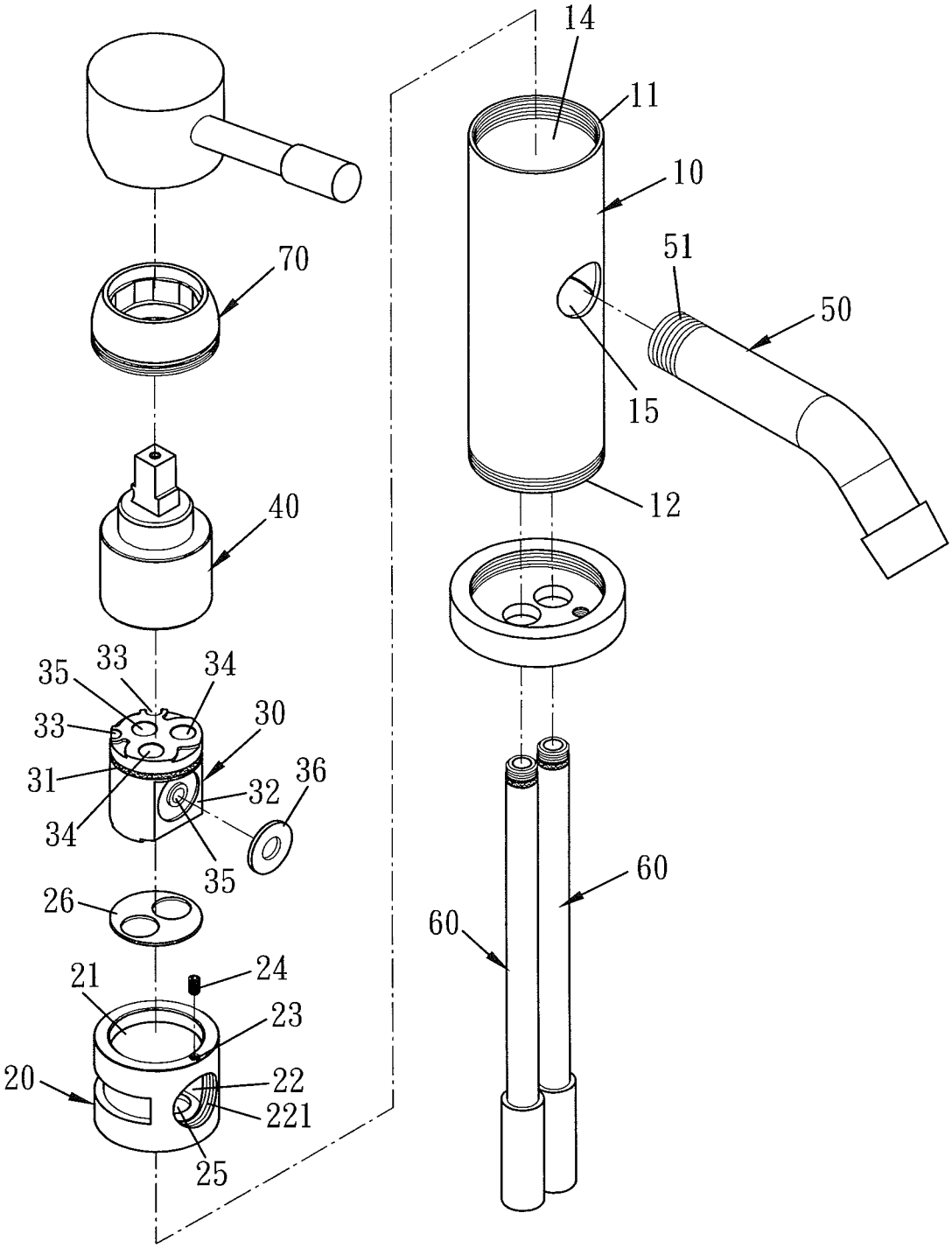
FIG. 1 is a perspective view showing the exploded components of a connecting structure of a faucet body and a control valve in accordance with a first embodiment of the present invention.
Figure 2:
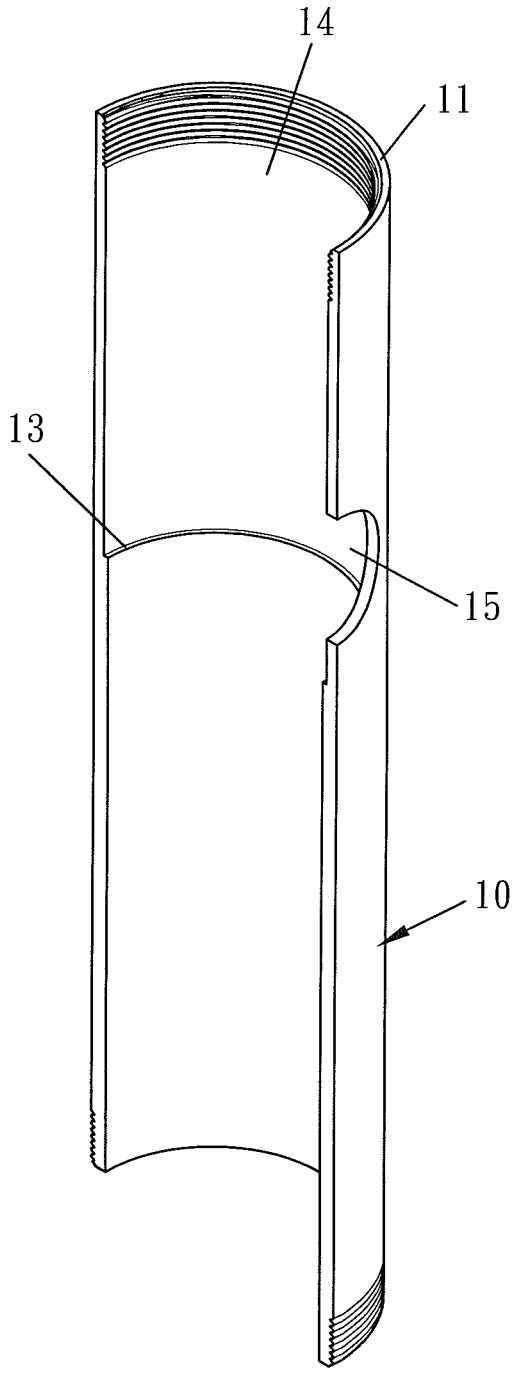
FIG. 2 is a cross-sectional perspective view showing the assembly of a faucet body of the connecting structure of the faucet body and the control valve in accordance with the first embodiment of the present invention.
Figure 3:
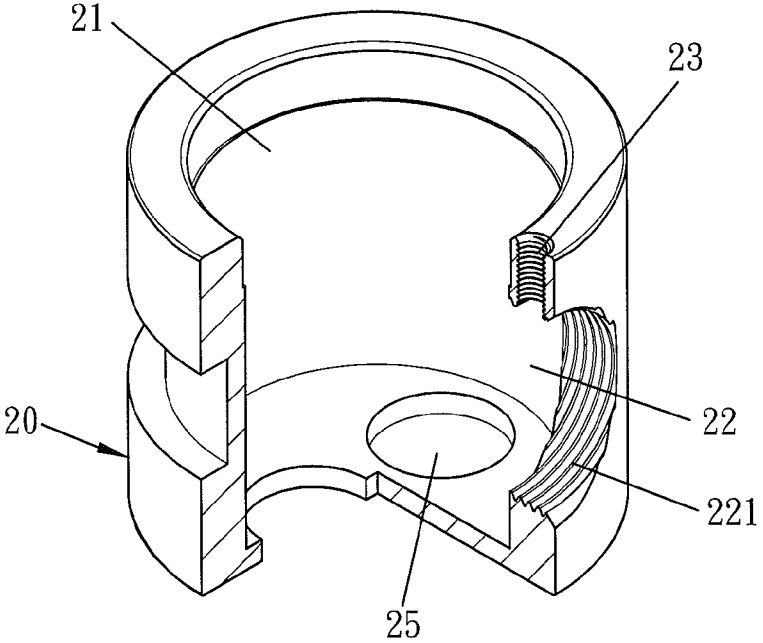
FIG. 3 is a cross-sectional perspective view showing the assembly of a fixing cylinder of the connecting structure of the faucet body and the control valve in accordance with the first embodiment of the present invention.
Figure 4:
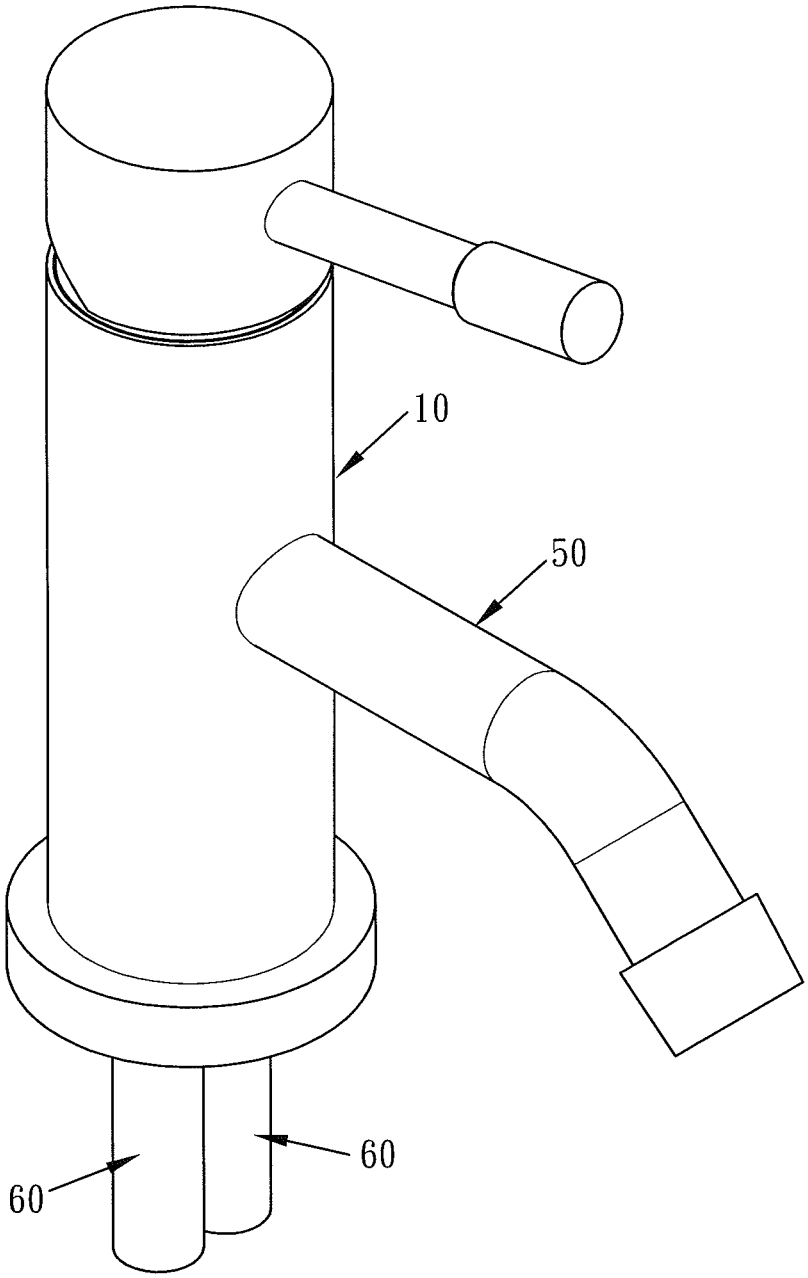
FIG. 4 is a perspective view showing the assembly of the connecting structure of the faucet body and the control valve in accordance with the first embodiment of the present invention.
Figure 5:
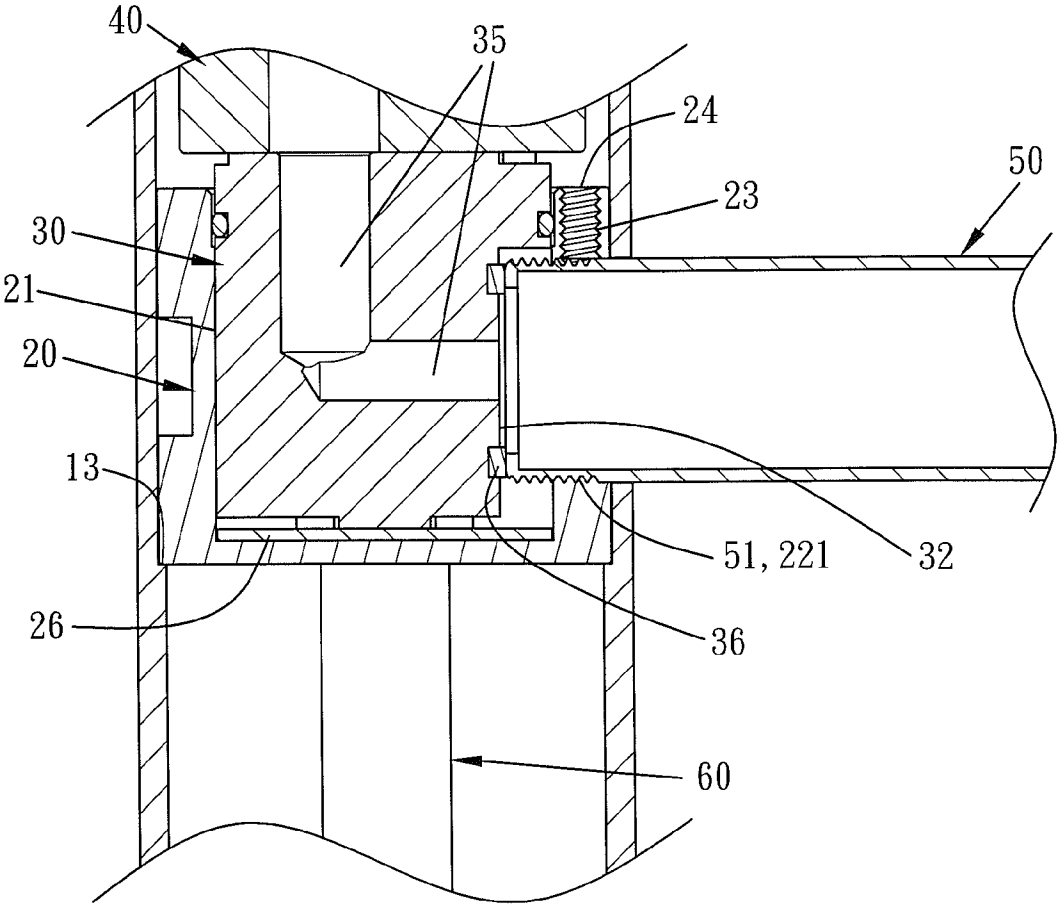
FIG. 5 is a cross-sectional view showing the assembly of the connecting structure of the faucet body and the control valve in accordance with the first embodiment of the present invention.

The present invention will be clearer from the following description when viewed together with the accompanying drawings, which show, for purpose of illustration only, the preferred embodiments in accordance with the present invention.

With reference to FIGS. 1-5, a connecting structure of a faucet body and a control valve according to a first embodiment of the present invention includes a faucet body 10 stamped and welded from a metal piece and formed in a hollow tube shape. The faucet body 10 includes a first segment 11, a second segment 12 relative to the first segment 11, a positioning rim 13 defined on an inner wall thereof between the first segment 11 and the second segment 12; a receiving space 14 formed between the positioning rim 13 and the first segment 11, and a connecting hole 15 formed on an outer wall thereof and communicating with the receiving space 14.

A fixing cylinder 20 is fitted into the receiving space 14 from the first segment 11 of the faucet body 10 and is retained with the positioning rim 13. The fixing cylinder 20 includes a circular cavity 21 in which an opening is defined and facing to the first segment 11 of the faucet body 10, an orifice 22 with inner threads 221 defined on an outer wall thereof and communicating with the connecting hole 15 of the faucet body 10, a threaded hole 23 formed on a top surface thereof to screw with a screw bolt 24 and passing through the orifice 22, two apertures 25 arranged on a bottom end thereof to insert two inlet pipes 60, and a stopping member 26 fixed on a bottom end of the circular cavity 21 of the fixing cylinder 20;

A guiding seat 30 is disposed in the circular cavity 21 of the fixing cylinder 20. The guiding seat 30 includes a seal ring 31 fitted on an upper side of an outer wall thereof and abutting against an inner wall of the fixing cylinder 20, a tangent face 32 defined on the outer wall thereof and corresponding to the orifice 22 of the fixing cylinder 20 and the connecting hole 15 of the faucet body 10, two grooves 33 defined on a top surface thereof, two inlets 34 passing downwardly therealong and having two lower ends which connect with the two inlet pipes 60, an outlet 35 extending toward the tangent face 32, and a sealing loop 36 fitted on the tangent face 32 and around the outlet 35.

A control valve 40 is inserted into the receiving space 14 from the first segment 11 of the faucet body 10 and is locked with a nut 70, so that a bottom end of the control valve 40 is biased against the guiding seat 30.

An outlet pipe 50 includes a screwing section 51 mounted on one end thereof and screwing with screw bolt 24 of the fixing cylinder 20 via the inner threads 221 of the orifice 22 of the fixing cylinder 20 and the connecting hole 15 of the faucet body 10 to position the outlet pipe 50. The one end of the outlet pipe 50, on which the screwing section 51 is mounted, contacts with the sealing loop 36 of the tangent face 32 of the guiding seat 30, thus closing a water flow.

In operation, a rod of the control valve 40 is rotated, so that cold water and hot water flow into the control valve 40 via the two inlets 34 from the two inlet pipes 60. Hence, a mixing rate and a flow amount of the cold water and the hot water are adjusted by ways of the control valve 40. Then, the water flow mixed from the cold water and the hot water flows into the outlet pipe 50 from the outlet 35 of the guiding seat 30.

Figure 6:
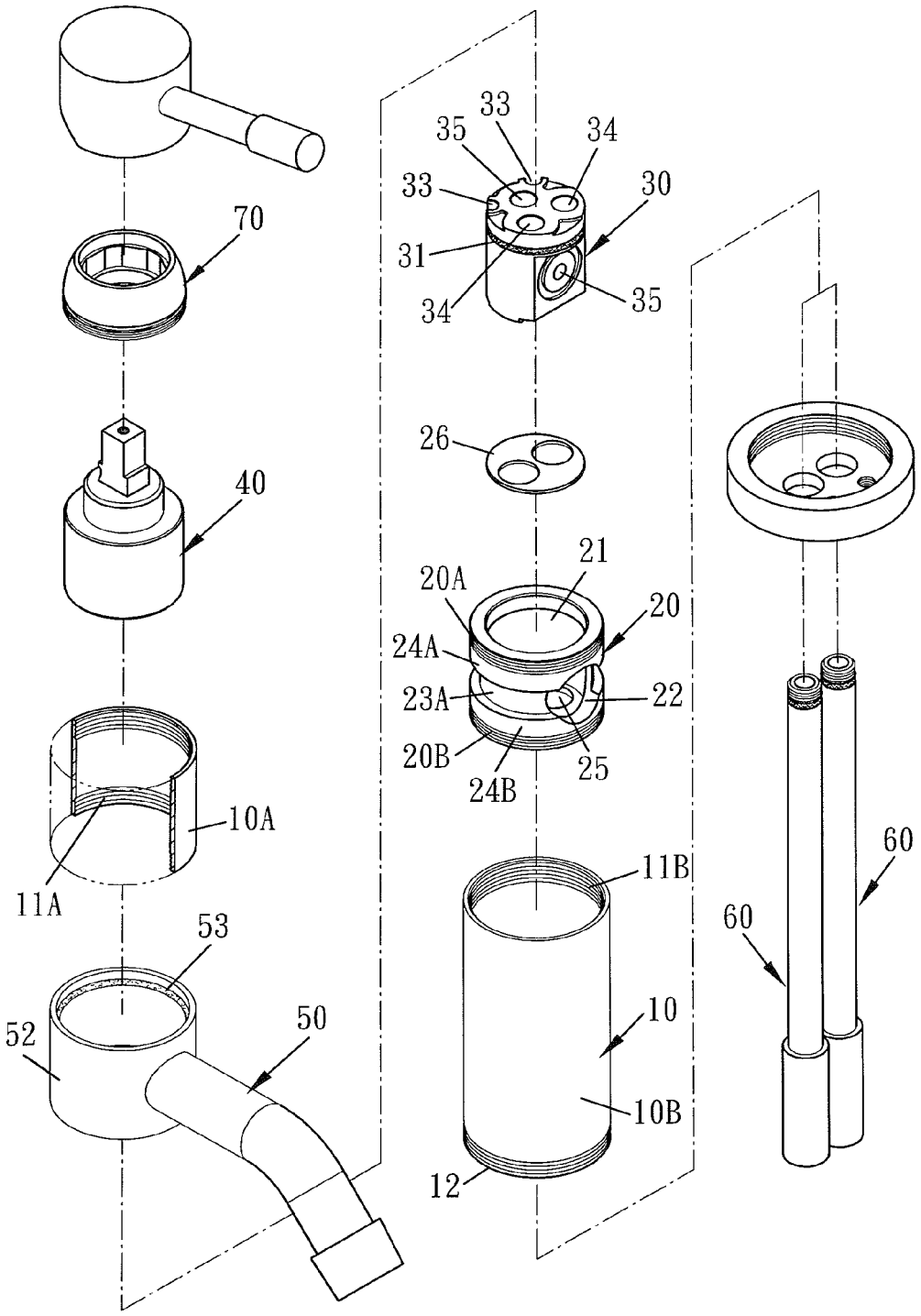
FIG. 6 is a perspective view showing the exploded components of a connecting structure of a faucet body and a control valve in accordance with a second embodiment of the present invention.
Figure 7:
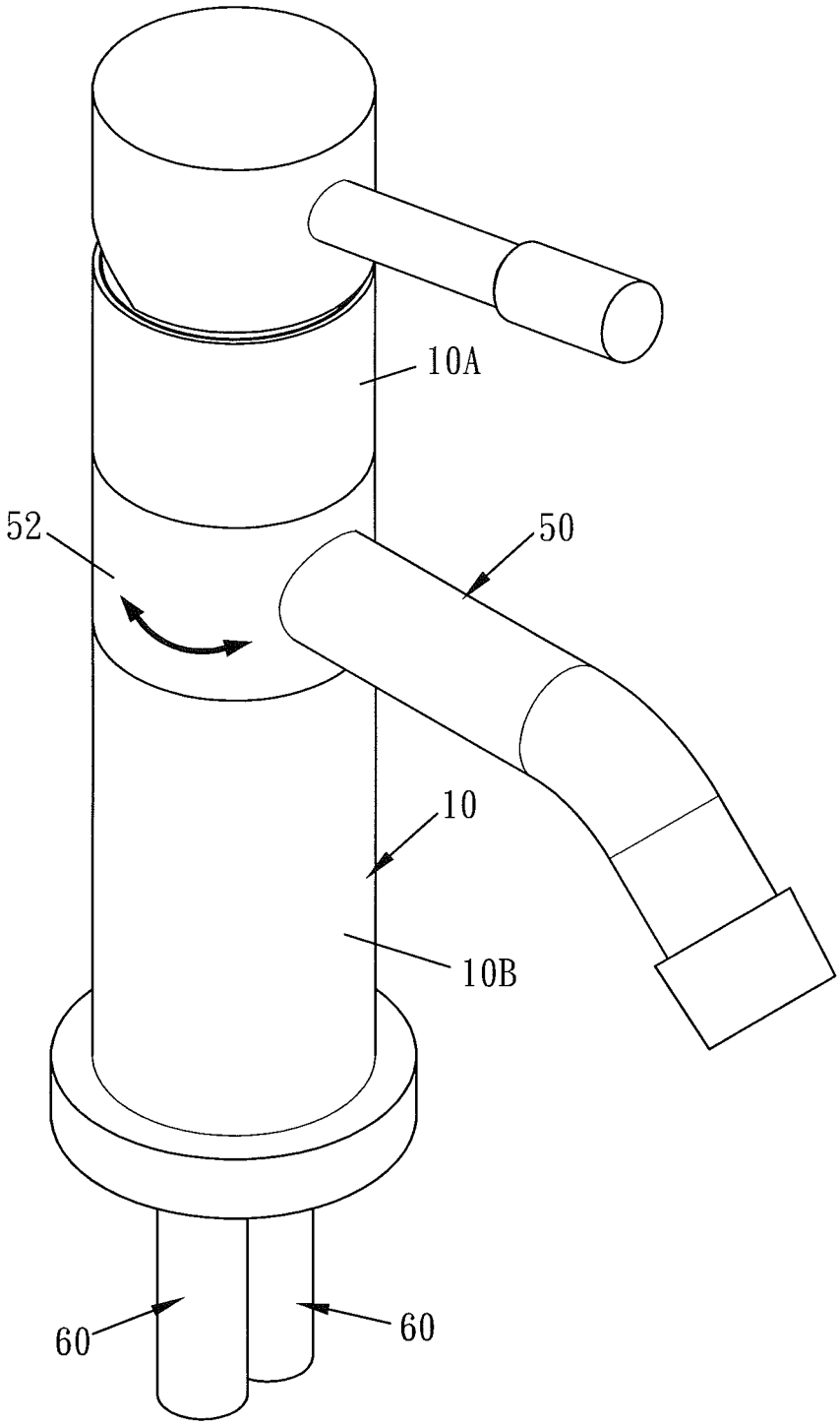
FIG. 7 is a perspective view showing the assembly and operation of the connecting structure of the faucet body and the control valve in accordance with the second embodiment of the present invention.
Figure 8:
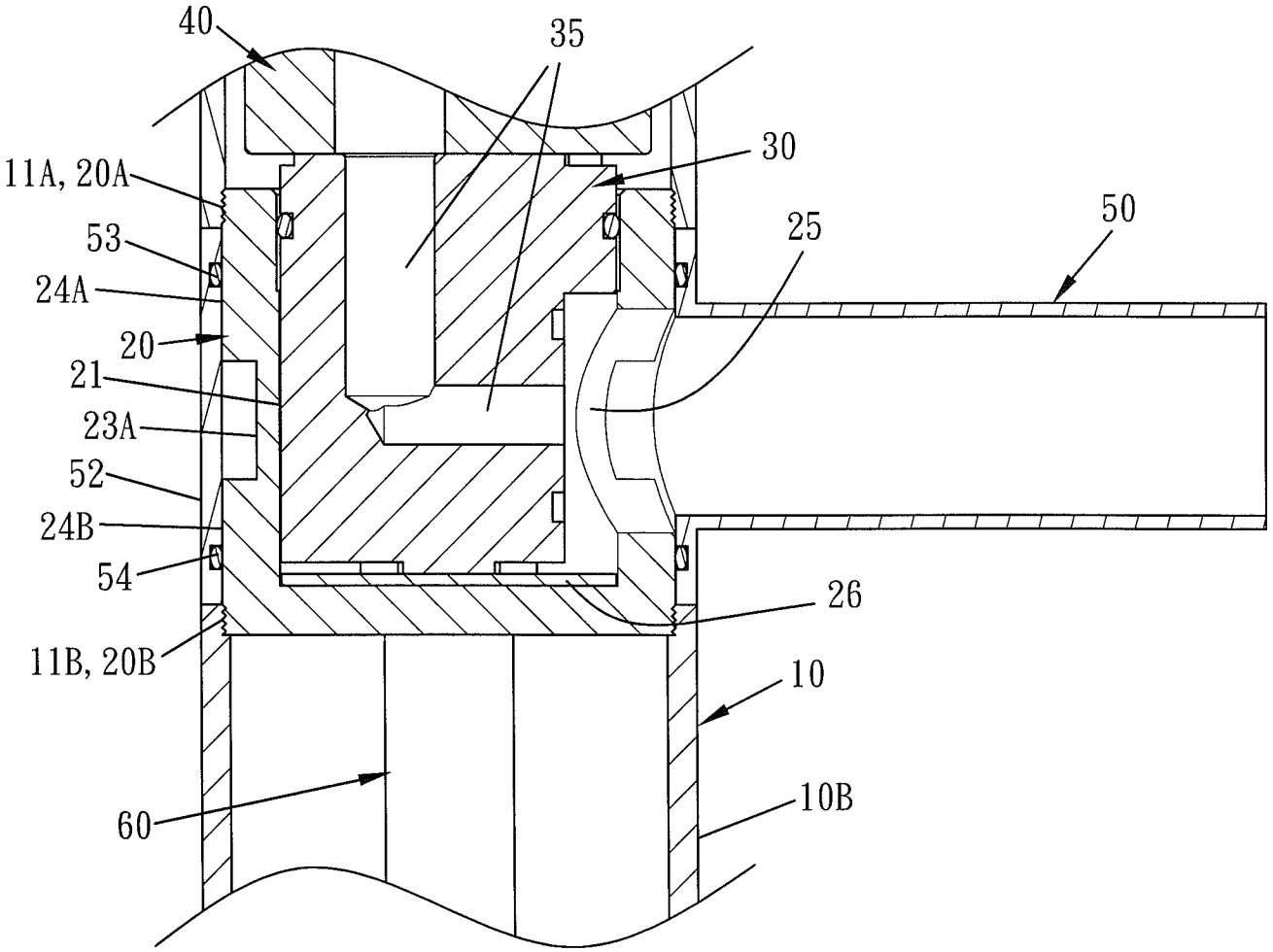
FIG. 8 is a cross-sectional view showing the assembly of the connecting structure of the faucet body and the control valve in accordance with the second embodiment of the present invention.

Referring further to FIGS. 6-8, a connecting structure of a faucet body and a control valve according to a second embodiment of the present invention includes a faucet body 10 stamped and welded from a metal piece and formed in a hollow tube shape. The faucet body 10 including includes a first tube part 10A and a second tube part 10B. The first tube part 10A has first inner threads 11A defined on an inner wall of one end thereof, and the second tube part 10B has second inner threads 11B formed on an inner wall of one end thereof.

A fixing cylinder 20, being circular, includes first outer threads 20A formed around an upper peripheral side of an outer wall thereof and screwing with first inner threads 11A of the first tube part 10A of the faucet body 10, and second outer threads 20B formed around an lower peripheral side of the outer wall thereof and screwing with second inner threads 11B of the second tube part 10B of the faucet body 10. The first tube part 10A and the second tube part 10B of the faucet body 10 are connected together by the fixing cylinder 20. The fixing cylinder 20 also includes a circular cavity 21 in which an opening is defined and facing upwardly, an orifice 22 defined on an outer wall thereof and communicating with the circular cavity 21, a slot 23A formed around a middle section of the outer wall thereof and communicating with the orifice 22, and a first retaining face 24A and a second retaining face 24B defined among the slot 23A, the first outer threads 20A, and the second outer threads 20B. Two apertures 25 are arranged on a bottom end of the fixing cylinder to insert two inlet pipes 60, and a stopping member 26 is fixed on a bottom end of the circular cavity 21 of the fixing cylinder 20.

A guiding seat 30 is disposed in the circular cavity 21 of the fixing cylinder 20. The guiding seat 30 includes a seal ring 31 fitted on an upper side of an outer wall thereof and abutting against an inner wall of the fixing cylinder 20, two grooves 33 defined on a top surface thereof, two inlets 34 passing downwardly therealong, and an outlet 35 extending toward the outer wall thereof. Two lower ends of the two inlets 34 couple with the two inlet pipes 60 via the bottom end of the fixing cylinder 20.

A control valve 40 is inserted into the second tube part 10B of the faucet body 10 and locks, with a nut 70, so that a bottom end of the control valve 40 is biased against the guiding seat 30.

An outlet pipe 50 includes one segment coupling with a circular fitting member 52 which is rotatably fitted on the fixing cylinder 20. The outlet pipe 50 movably rotates to communicate with the outlet 35 of the guiding seat 30 through the orifice 22 and the slot 23A of the fixing cylinder 20. The fitting member 52 has a first anti-leak ring 53 mounted on an upper side of an inner wall thereof and retaining with the first retaining face 24A of the fixing cylinder 20, and a second anti-leak ring 54 mounted on a lower side of the inner wall thereof and retaining with the second retaining face 24B of the fixing cylinder 20, thus closing a water flow.

In operation, a rod of the control valve 40 is rotated, so that cold water and hot water flow into the control valve 40 via the two inlets 34 from the two inlet pipes 60. Hence, a mixing rate and a flow amount of the cold water and the hot water are adjusted by ways of the control valve 40. Then, the water flow mixed from the cold water and the hot water flows into the outlet pipe 50 from the outlet 35 of the guiding seat 30, and the outlet pipe 50 movably rotates to any desired angle.

Figure 9:
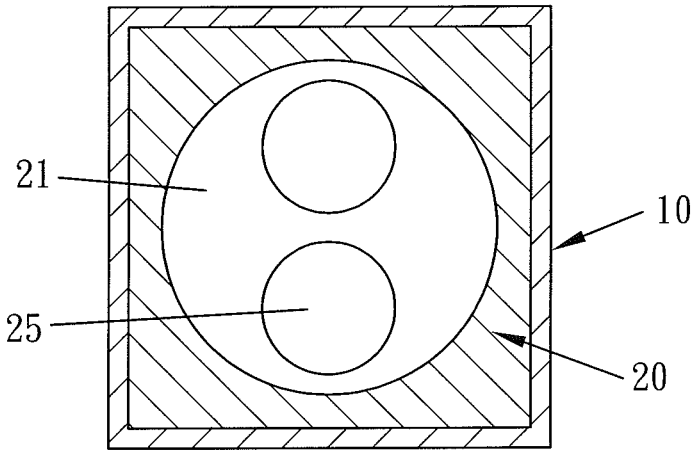
FIG. 9 is a cross-sectional view showing the assembly of a faucet body and a fixing cylinder of a connecting structure of a faucet body and a control valve in accordance with a third embodiment of the present invention.
Figure 10:
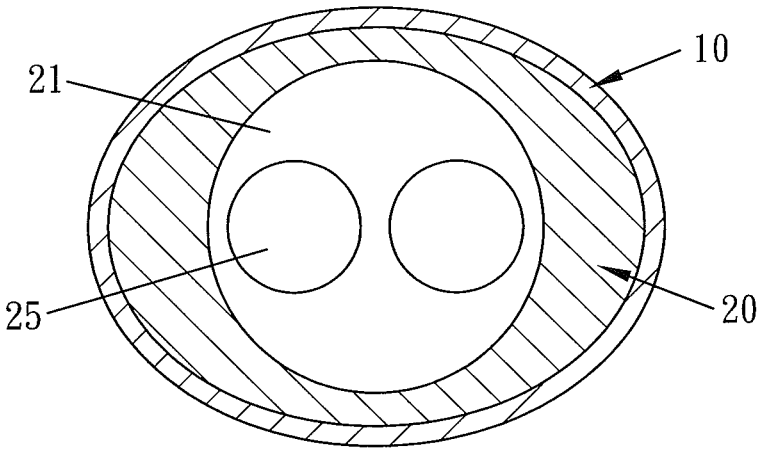
FIG. 10 is a cross-sectional view showing the assembly of a faucet body and a fixing cylinder of a connecting structure of a faucet body and a control valve in accordance with a fourth embodiment of the present invention.
Figure 11:
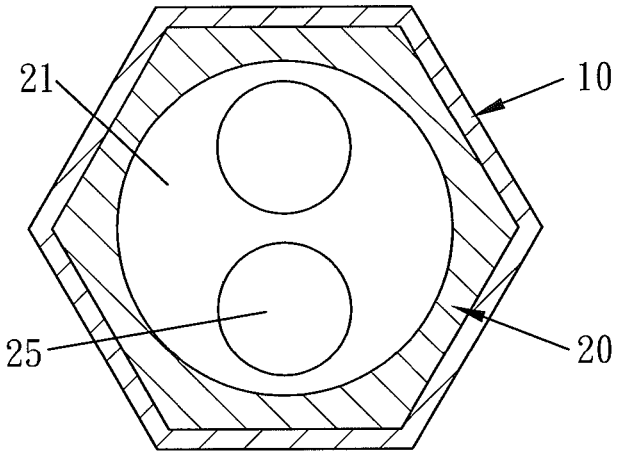
FIG. 11 is a cross-sectional view showing the assembly of a faucet body and a fixing cylinder of a connecting structure of a faucet body and a control valve in accordance with a fifth embodiment of the present invention.

In addition, a faucet body 10 of a third embodiment of the present invention is square as shown in FIG. 9; a faucet body 10 of a fourth embodiment of the present invention is oval as illustrated in FIG. 10; and a faucet body 10 of a fifth embodiment of the present invention is hexagonal as shown in FIG. 11. The faucet body 10 is also formed in a geometry shape. Thereby, a shape of the faucet body 10 corresponds to that of the fixing cylinder 20 (such as a square shape, an oval shape, a hexagonal shape, or a geometrical shape), and a fixing cylinder 20 of the third embodiment, the fourth embodiment, and the fifth embodiment includes a circular cavity 21 defined therein and two apertures 25 defined in a bottom end thereof to insert two inlet pipes 60 via the bottom end of the fixing cylinder 20.

Figure 12:
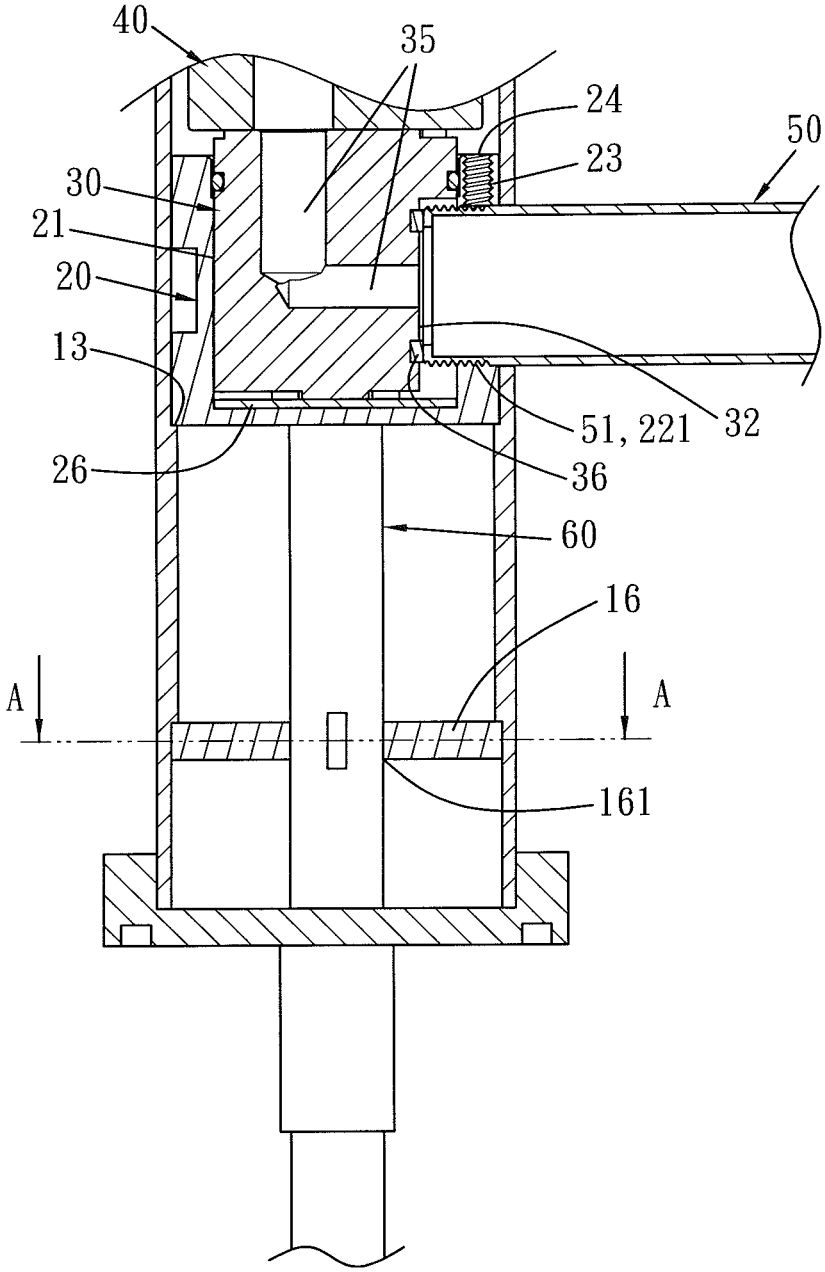
FIG. 12 is a cross sectional view showing the operation of a connecting structure of a faucet body and a control valve in accordance with a sixth embodiment of the present invention.
Figure 13:
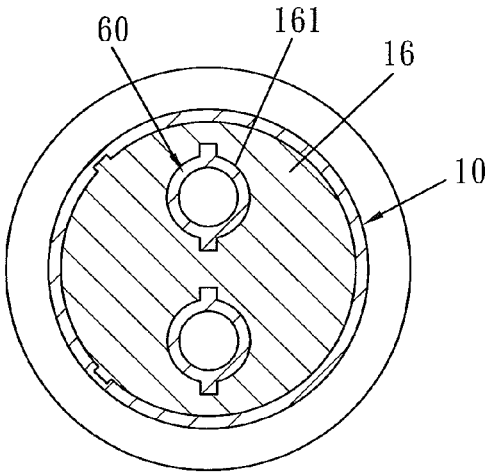
FIG. 13 is a cross sectional view taken along lines A-A of FIG. 12.

As shown in FIGS. 12 and 13, the faucet body 10 includes a locking piece 16 retained with the inner wall thereof, and the locking piece 16 has two pores 161 defined therein to insert and lock the two inlet pipes 60.

Thereby, the connecting structure of the faucet body and the control valve of the present invention has the following advantages:

1. The faucet body 10 is stamped and welded from the metal piece and is formed in a hollow tube shape to match with the fixing cylinder 20 including the circular cavity 21. The guiding seat 30 and the control valve 40 are fixed in the faucet body 10, and the shape of the faucet body 10 is geometrical and variable, thus increasing an aesthetics appearance.

2. The faucet body 10 is stamped and welded from the metal piece and is formed in a hollow tube shape to match with the fixing cylinder 20 including the circular cavity 21. The guiding seat 30 and the control valve 40 are fixed in the faucet body 10, so an interior of the faucet body 10 need not be worked precisely, thus accelerating the working process and lowering material and production costs.

While various embodiments in accordance with the present invention have been shown and described, it is clear to those skilled in the art that further embodiments may be made without departing from the scope of the present invention.

What is claimed is:

1. A connecting structure comprising:

a faucet body stamped and welded from a metal piece and formed in a hollow tube shape, with the faucet body including a first segment, a second segment relative to the first segment, a positioning rim defined on an inner wall thereof between the first segment and the second segment, and a receiving space formed between the positioning rim and the first segment;

two inlet pipes;

a fixing cylinder formed in a shape corresponding to a shape of an interior of the faucet body, with the fixing cylinder fitted into the receiving space from the first segment of the faucet body and retaining with the positioning rim, with the fixing cylinder including a circular cavity, an orifice defined on an outer wall thereof and communicating with the circular cavity, and two apertures arranged on a bottom end thereof to insert the two inlet pipes;

a guiding seat disposed in the circular cavity of the fixing cylinder, with the guiding seat including two grooves defined on a top surface thereof, and two inlets passing downwardly therealong and having two lower ends which connect with the two inlet pipes;

a control valve inserted into the receiving space from the first segment of the faucet body, with a bottom end of the control valve biased against the guiding seat; and an outlet pipe coupling with the faucet body and communicating with an outlet of the guiding seat, wherein the faucet body also includes a connecting hole formed on an outer wall thereof to connect with a screwing section of the outlet pipe and connecting the receiving space of the faucet body, wherein the orifice of the fixing cylinder has inner threads, and wherein the outlet pipe includes the screwing section mounted on one end thereof and screwing with the inner threads of the orifice of the fixing cylinder via the connecting hole of the faucet body.

2. A connecting structure comprising:

a faucet body stamped and welded from a metal piece and formed in a hollow tube shape, with the faucet body including a first segment, a second segment relative to the first segment, a positioning rim defined on an inner wall thereof between the first segment and the second segment, and a receiving space formed between the positioning rim and the first segment;

two inlet pipes;

a fixing cylinder formed in a shape corresponding to a shape of an interior of the faucet body, with the fixing cylinder fitted into the receiving space from the first segment of the faucet body and retaining with the positioning rim, with the fixing cylinder including a circular cavity, an orifice defined on an outer wall thereof and communicating with the circular cavity, and two apertures arranged on a bottom end thereof to insert the two inlet pipes;

a guiding seat disposed in the circular cavity of the fixing cylinder, with the guiding seat including two grooves defined on a top surface thereof, and two inlets passing downwardly therealong and having two lower ends which connect with the two inlet pipes;

a control valve inserted into the receiving space from the first segment of the faucet body, with a bottom end of the control valve biased against the guiding seat; and an outlet pipe coupling with the faucet body and communicating with an outlet of the guiding seat, wherein the fixing cylinder also includes a threaded hole formed on a top surface thereof to screw with a screw bolt, with the screw bolt passing through the orifice.

3. The connecting structure as claimed in claim 2, wherein the faucet body also includes a connecting hole formed on an outer wall thereof to connect with a screwing section of the outlet pipe and connecting the receiving space of the faucet body.

4. The connecting structure as claimed in claim 2, wherein the circular cavity of the fixing cylinder has a stopping member fixed on a bottom end thereof.

5. The connecting structure of as claimed in claim 2, wherein the guiding seat including a seal ring fitted on an upper side of an outer wall thereof and abutting against an inner wall of the fixing cylinder.

6. The connecting structure as claimed in claim 2, wherein the guiding seat includes a tangent face defined on the outer wall thereof and corresponding to the orifice of the fixing cylinder, with a sealing loop fitted on the tangent face and around the outlet, and wherein the one end of the outlet pipe, on which the screwing section is mounted, contacts with the sealing loop of the tangent face, thus closing a water flow.

* * * * *